US006622940B2

(12) United States Patent
Huang

(10) Patent No.: US 6,622,940 B2
(45) Date of Patent: Sep. 23, 2003

(54) SPRINKLER CAPABLE OF DISTRIBUTING WATER IN AN EVEN PATTERN

(76) Inventor: Huang-Fu Huang, No. 22, Lane1, Sec.3 Chang-Nan Rd., Chin-Fen Village Fen-Yuan Hsiang, Chang-Hua Hsien (TW)

( * ) Notice: Subject to any disclaimer, the term of this patent is extended or adjusted under 35 U.S.C. 154(b) by 173 days.

(21) Appl. No.: 09/957,608

(22) Filed: Sep. 21, 2001

(65) Prior Publication Data

US 2003/0057296 A1 Mar. 27, 2003

(51) Int. Cl.[7] ..... B05B 3/00

(52) U.S. Cl. ..... 239/225.1; 239/237; 239/240; 239/241; 239/263; 239/DIG. 1

(58) Field of Search ..... 239/225.1, 237, 239/240, 241, 263, 230–233, 251, 256, DIG. 1

(56) References Cited

U.S. PATENT DOCUMENTS 3,669,356 A * 6/1972 Senninger ..... 239/230
3,979,066 A * 9/1976 Fortner ..... 239/252
4,330,087 A * 5/1982 Wood et al. ..... 239/233
5,123,597 A * 6/1992 Bendall ..... 239/124

* cited by examiner

*Primary Examiner*—Lisa A. Douglas
(74) *Attorney, Agent, or Firm*—Harrison & Egbert

(57) ABSTRACT

A water sprinkler includes a main body, a primary nozzle, and an auxiliary nozzle. The main body is provided with a water admitting pipe in communication with the primary nozzle by which a portion of the incoming water is distributed to the areas farther from the sprinkler. The auxiliary nozzle is rotatably mounted on the top end of the main body and is provided with an inclined edge forming adjustably a gap in conjunction with an inclined guide edge of a water chamber of the main body. The rest of the incoming water is guided into the water chamber from which the water is distributed via the gap to the areas closer to the sprinkler.

1 Claim, 8 Drawing Sheets

SPRINKLER CAPABLE OF DISTRIBUTING WATER IN AN EVEN PATTERN

BACKGROUND OF THE INVENTION

1. Field of the Invention

The present invention relates generally to a sprinkler, and more particularly to a sprinkler which is provided with means to distribute water in an even pattern within a distribution range thereof.

2. Description of Related Art

As shown in FIG. 1 a prior art lawn sprinkler is capable of watering a relatively large area of a lawn and is formed of a main body 10, a nozzle 11, a rotation guiding member 12, and a position confining member 13. The nozzle 11 works in conjunction with the rotation guiding member 12 and the position confining member 13 such that the parabolic streams 14 of water are distributed by the prior art lawn sprinkler.

Such a prior art lawn sprinkler as described above is defective in design because it is incapable of a uniform distribution of water, as illustrated in FIG. 2 in which the water distribution points are denoted by the letter "A". The water distribution is relatively sparse in the areas closer to the main body 10 of the prior art lawn sprinkler. Even though the uneven water distribution can be corrected by adjusting the angle of elevation of the nozzle 11, it is economically infeasible to do such adjustment one by one in a large area in which a number of the sprinklers are located.

BRIEF SUMMARY OF THE INVENTION

The primary objective of the present invention is therefore to provide a sprinkler which is free of the deficiency of the prior art sprinkler described above.

In keeping with the principle of the present invention, the foregoing objective of the present invention is attained by the sprinkler comprising a main body, a primary nozzle, and an auxiliary nozzle. The main body is provided with a water admitting pipe in communication with the primary nozzle by which a portion of the incoming water is distributed to the areas farther from the sprinkler. The auxiliary nozzle is mounted on the top of the main body and is provided with an inclined edge forming adjustably a gap in conjunction with an inclined guide edge of a water chamber of the main body. The rest of the incoming water is guided into the water chamber from which the water is distributed via the gap to the areas closer to the sprinkler.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
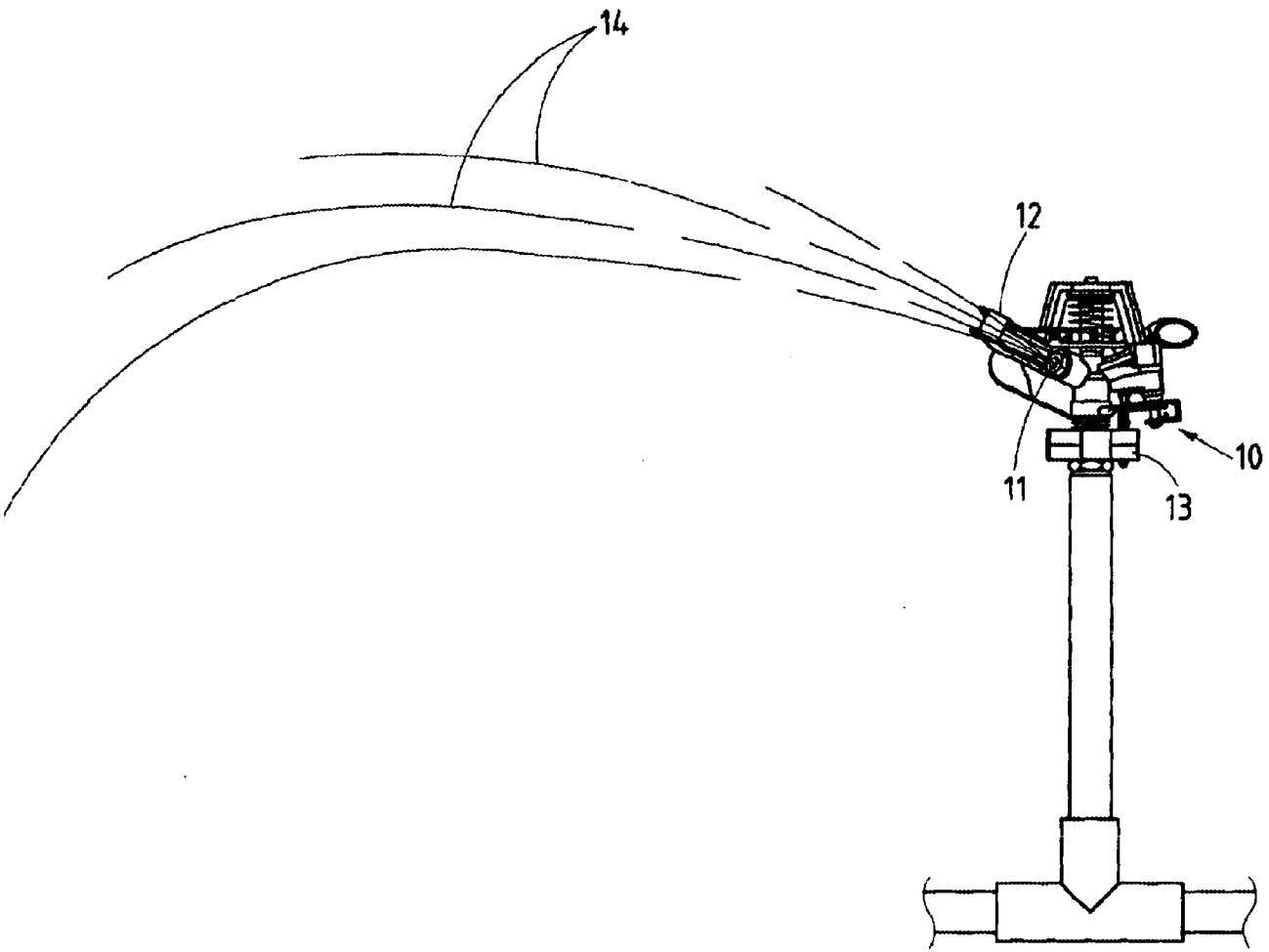
FIG.1 PRIOR ART
FIG. 1 shows a schematic view of a prior art sprinkler in operation.
Figure 2:
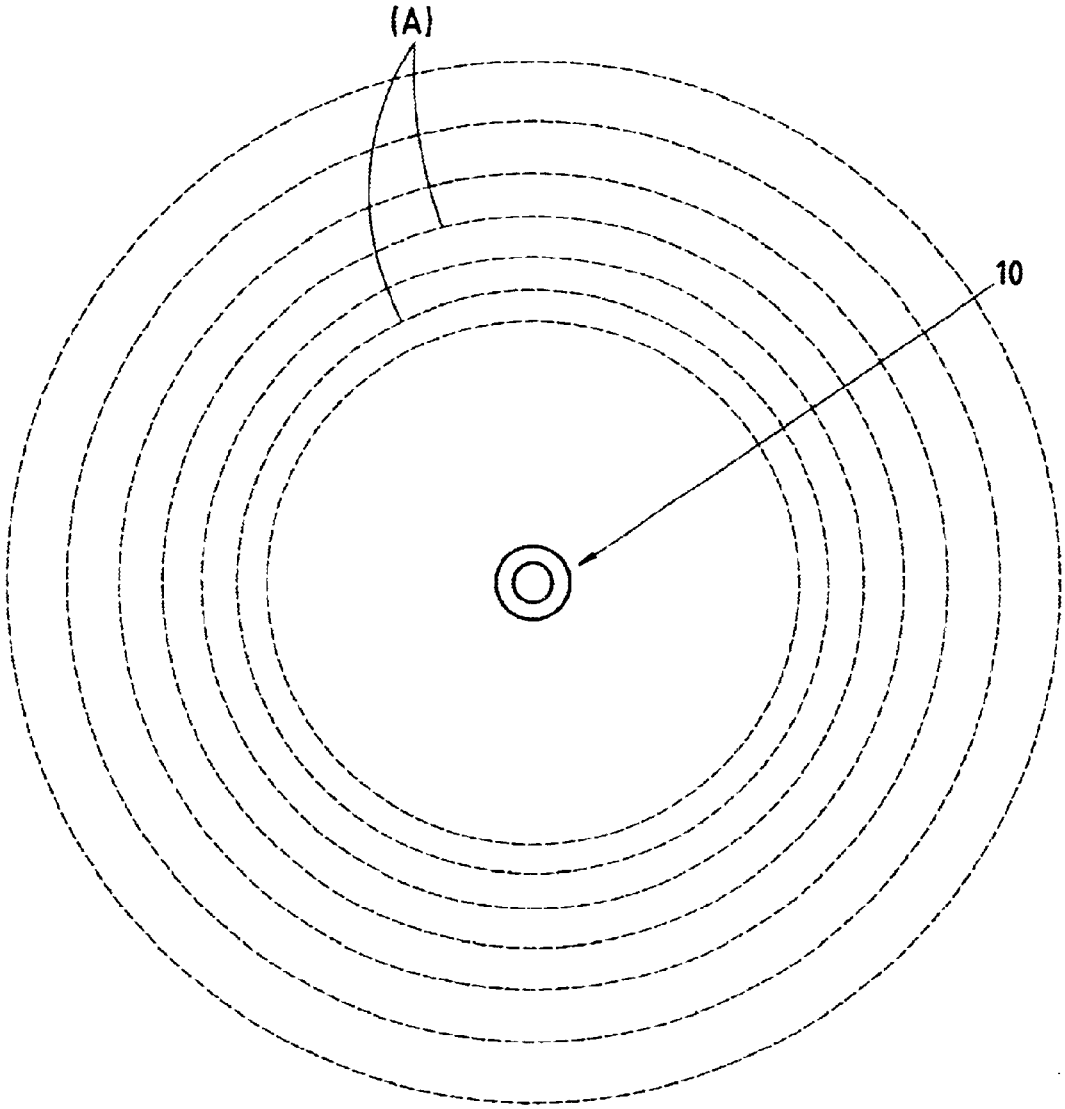
FIG.2 PRIOR ART
FIG. 2 shows a schematic view of the water distribution pattern of the prior art sprinkler.
Figure 3:
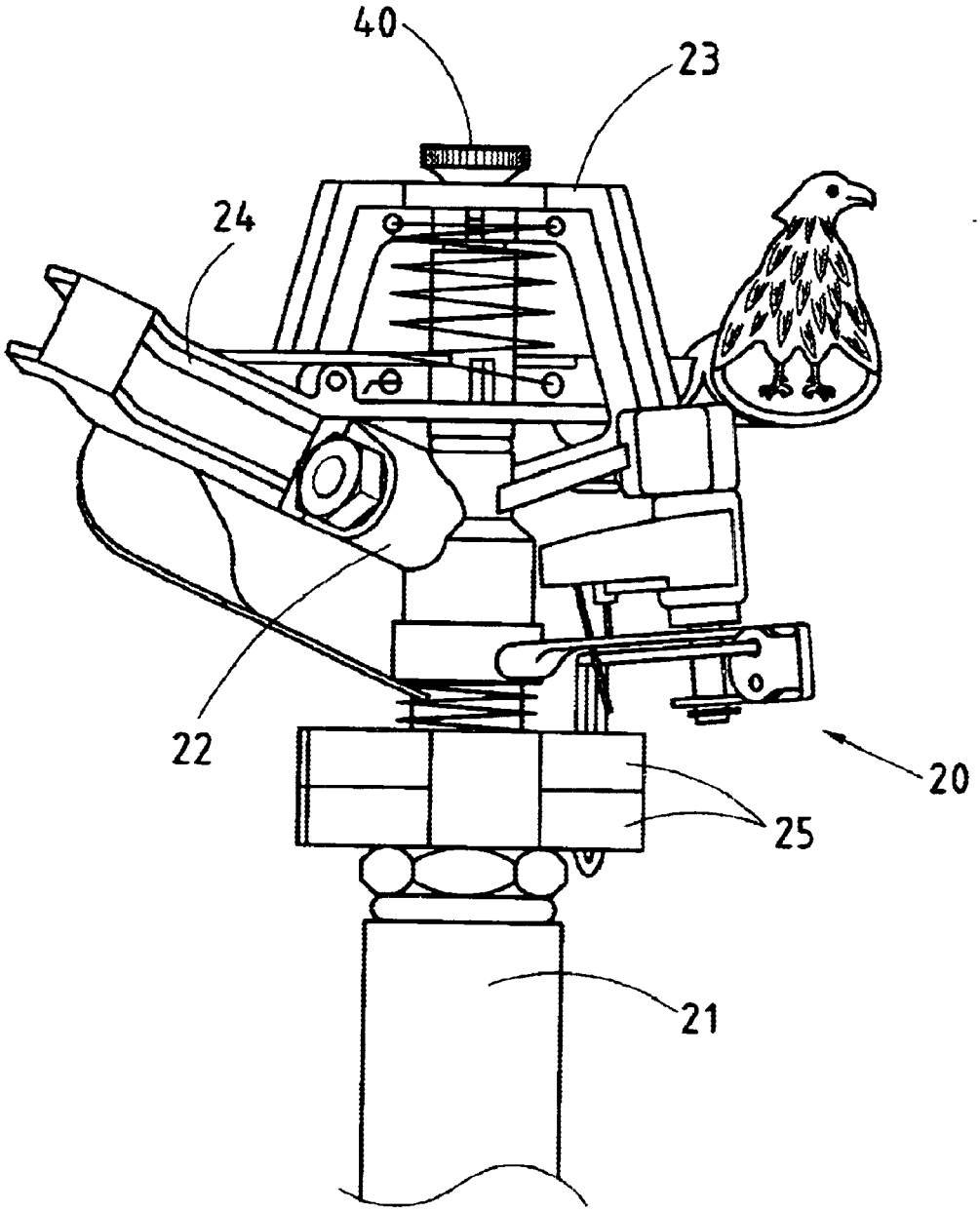
FIG. 3 shows a schematic plan view of a sprinkler of the present invention.
Figure 4:
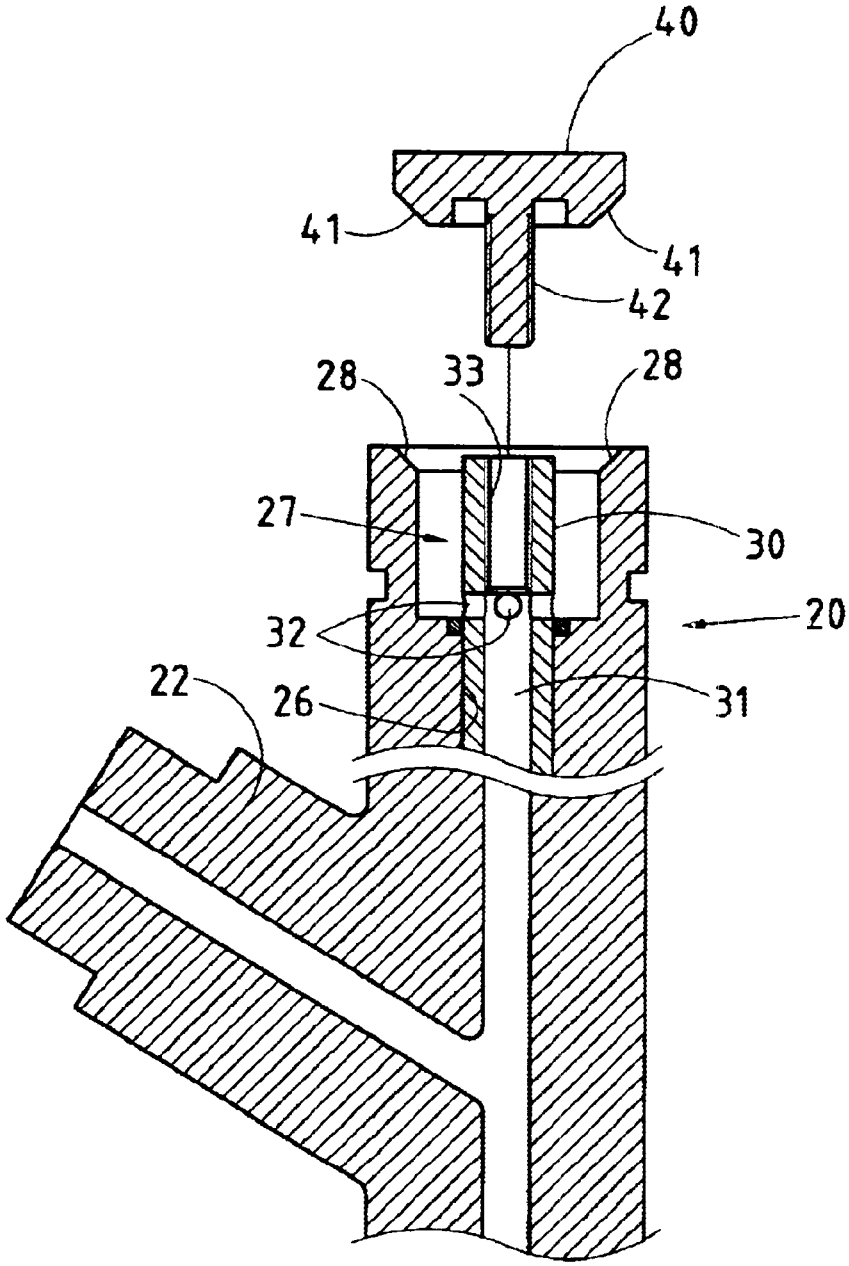
FIG. 4 shows a partial exploded view of the sprinkler of the present invention.

As shown in FIGS. 3–7, a sprinkler of the present invention has a main body 20 which comprises a water admitting pipe 21, a primary nozzle 22 in communication with the water admitting pipe 21, a top frame 23, a rotation guiding member 24, and a position confining member 25.

The water is introduced into the primary nozzle 22 via the water admitting pipe 21 such that a portion of the water is emitted via the primary nozzle 22. The primary nozzle 22 in operation is enabled to turn by the rotation guiding member 24 in conjunction with the position confining member 25.

The sprinkler of the present invention is characterized by the main body 20 which further comprises a pipe slot 26, a water chamber 27, a connection pipe 30, and an auxiliary nozzle 40.

The pipe slot 26 is located in the top segment of the main body 20 for receiving the connection pipe 30.

The water chamber 27 is located in the top segment of the main body 20 and is provided along the edge of the top opening thereof with an inclined guide portion 28.

The connection pipe 30 is received in the pipe slot 26 and is provided with a through channel 31 extending along the longitudinal direction of the connection pipe 30 and in communication with the water admitting pipe 21. The through channel 31 is provided in the top end with inner threads 33. The connection pipe 30 is further provided in proximity of the top end thereof with a through hole 32 via which the connection pipe 30 is in communication with the water chamber 27.

Figure 5:
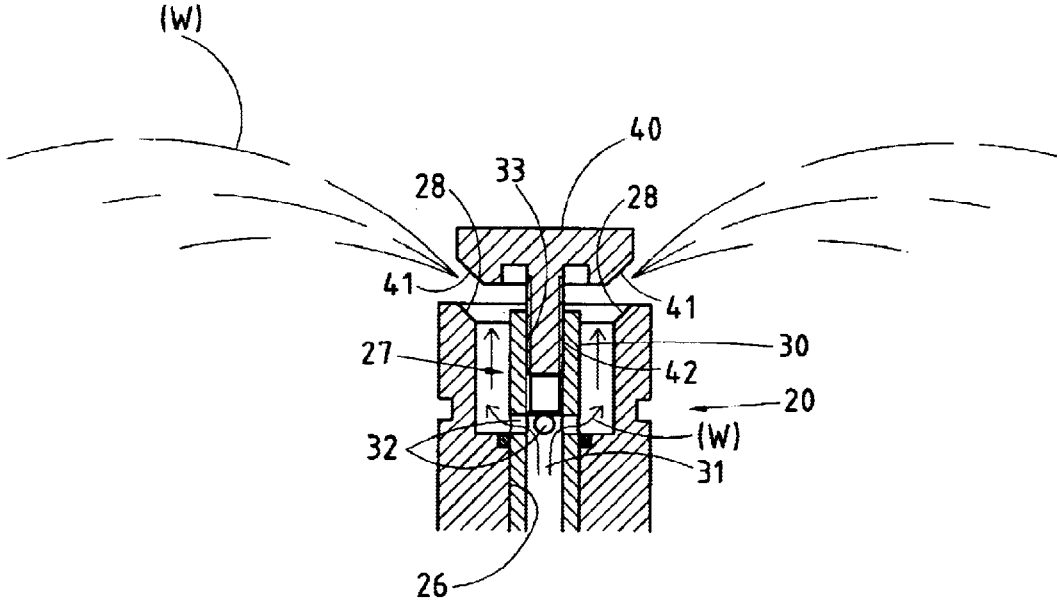
FIG. 5 shows a longitudinal sectional view of the auxiliary nozzle of the present invention in operation.
Figure 6:
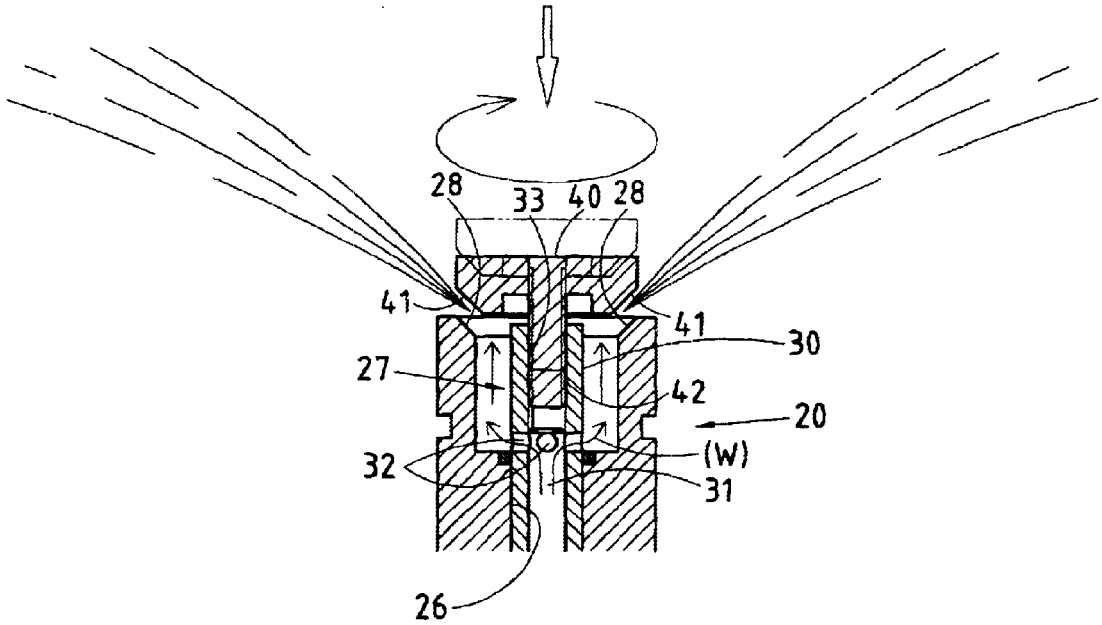
FIG. 6 shows another longitudinal sectional view of the auxiliary nozzle of the present invention in operation.
Figure 7:
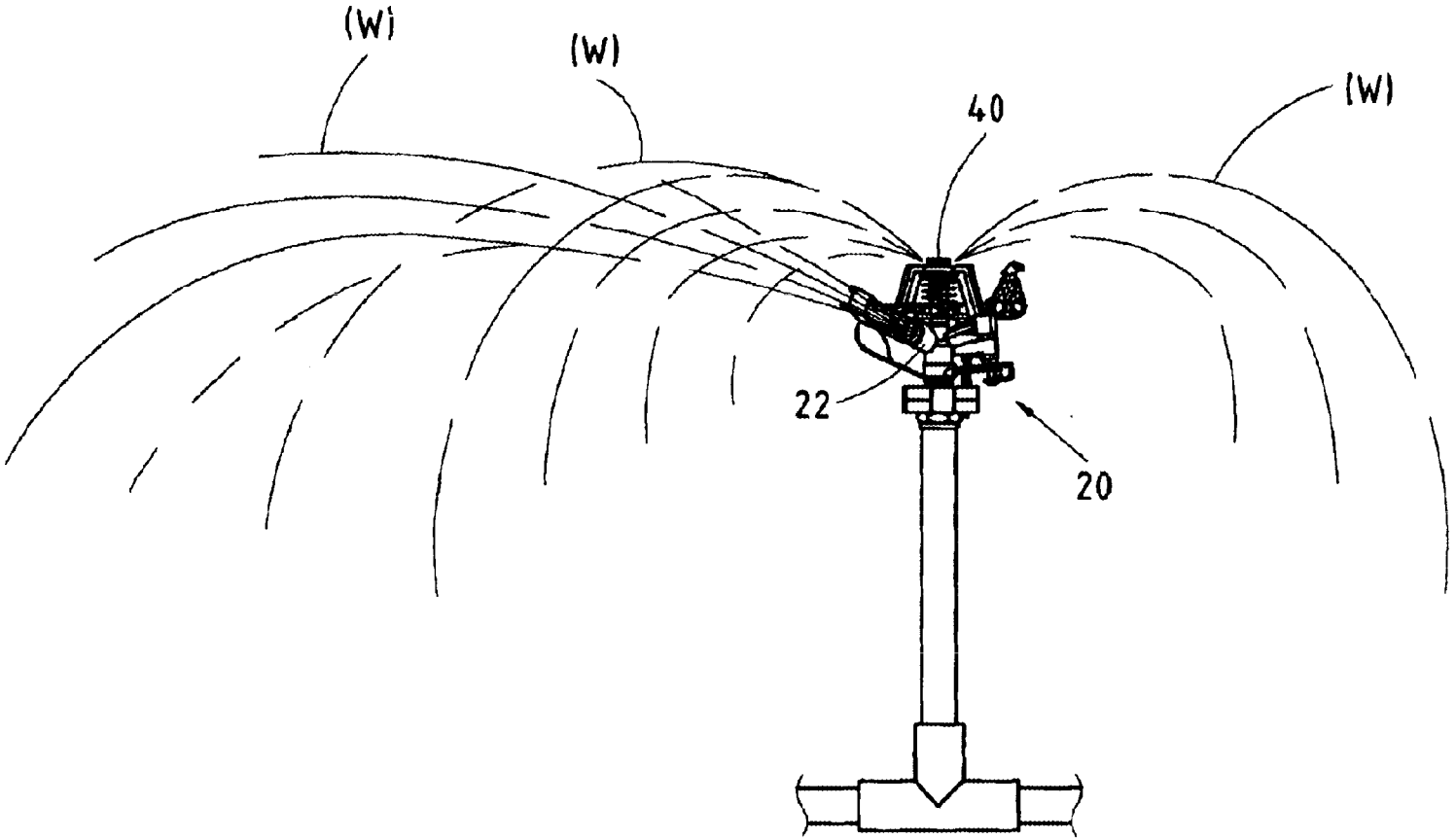
FIG. 7 shows a schematic view of the sprinkler of the present invention in operation.

The auxiliary nozzle 40 is provided along the edge of the underside thereof with an inclined portion 41 corresponding in inclination to the inclined guide portion 28 of the water chamber 27. The auxiliary nozzle 40 is further provided with a threaded rod 42 extending from the center of the underside thereof. The auxiliary nozzle 40 is mounted on the top end of the main body 20 such that the threaded rod 42 of the auxiliary nozzle 40 is rotatably engaged with the inner threads 33 of the connection pipe 30, and that a gap is formed between the inclined portion 41 of the auxiliary nozzle 40 and the inclined guide portion 28 of the water chamber 27. The gap is adjusted in size by turning the auxiliary nozzle 40 clockwise or counterclockwise. As described above, a portion of the incoming water is discharged via the primary nozzle 22. The rest of the incoming water is guided into the water chamber 27 via the through channel 31 and the through hole 32 of the connection pipe 30 and is then discharged via the gap between the inclined portion 41 of the auxiliary nozzle 40 and the inclined guide portion 28 of the water chamber 27, as shown in FIGS. 5, 6, and 7 in which the water streams are denoted by the letter "W".

Figure 8:
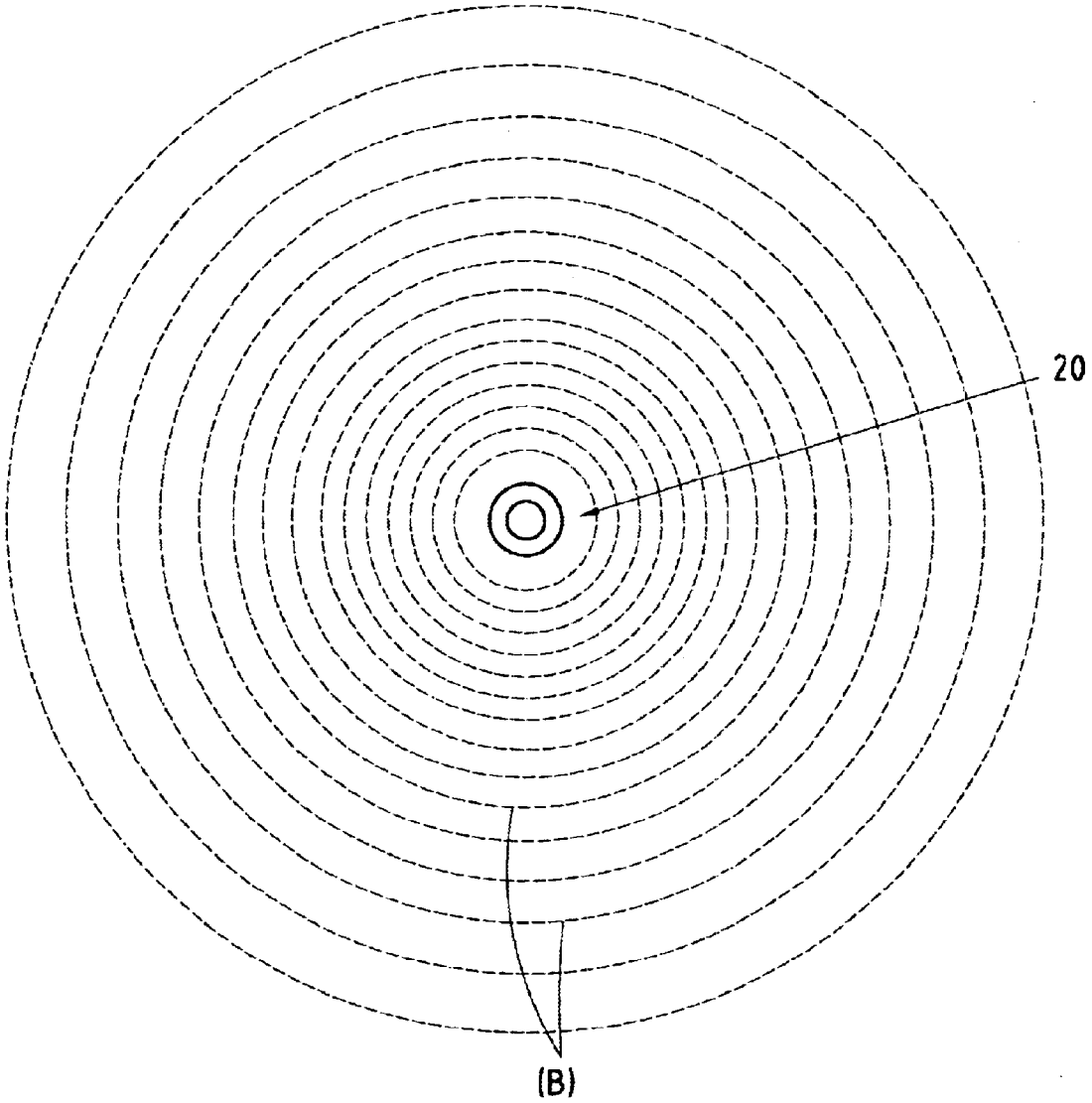
FIG. 8 shows a schematic view of the water distribution pattern of the sprinkler of the present invention.

As illustrated in FIG. 8, the sprinkler of the present invention is capable of a uniform distribution of water throughout the water distribution range of the sprinkler. In other words, the water distribution points "B" are uniformly located within the water distribution range of the sprinkler, even in the area close to the main body 20 of the sprinkler.

The present invention described above is to be regarded in all respects as being merely illustrative and not restrictive. Accordingly, the present invention may be embodied in other specific forms without deviating from the spirit thereof. The present invention is therefore to be limited only by the scope of the following claim.

I claim:

1. A water sprinkler comprising a main body which comprises a water admitting pipe connected to a water source, a primary nozzle, a top frame, a rotation guiding member, and a position confining member, said primary nozzle being in communication with said water admitting pipe for discharging a portion of incoming water which is guided into said primary nozzle via said water admitting pipe, said primary nozzle being enabled to rotate by said rotation guiding member in conjunction with said position confining member;

wherein said main body further comprises:

a pipe slot located in a top segment of said main body;

a water chamber located in the top segment of said main body and provided along an opening edge of a top end thereof with an inclined guide portion;

a connection pipe received in said pipe slot and comprised of a through channel extending along the longitudinal direction thereof such that said through channel is in communication with said water admitting pipe, said through channel provided in a top end with inner threads whereby said connection pipe is further provided in proximity of a top end with a through hole for communicating said through channel of said connection pipe with said water chamber; and an auxiliary nozzle provided along an underside edge with an inclined portion corresponding in inclination to said inclined guide portion of said water chamber, said auxiliary nozzle further comprised of a threaded rod extending from the center of the underside of said auxiliary nozzle, said auxiliary nozzle being rotatably mounted on a top end of said main body such that said threaded rod of said auxiliary nozzle is rotatably engaged with said inner threads of said connection pipe, and such that a gap is adjustably formed between said inclined portion of said auxiliary nozzle and said inclined guide portion of said water chamber whereby said gap is intended to discharge the rest of the incoming water which is guided into said water chamber from said water admitting pipe via said through channel and said through hole of said connection pipe.

* * * * *